US005727460A

United States Patent [19]

Gaglione et al.

[11] Patent Number: 5,727,460

[45] Date of Patent: Mar. 17, 1998

[54] PRINTING MACHINE WITH GOLD BLOCKING PRESS TYPE PRINTING STATION

[75] Inventors: Patrick Gaglione, Vaires Sur Marne; Jean-Louis Dubuit, Paris, both of France

[73] Assignee: Societe D'Exploitation des Machines Dubuit, Noisy Le Grand, France

[21] Appl. No.: 653,249

[22] Filed: May 24, 1996

[30] Foreign Application Priority Data

May 24, 1995 [FR] France ..... 95 06212

[51] Int. Cl.[6] ..... B41F 17/00

[52] U.S. Cl. ..... 101/44; 101/11

[58] Field of Search ..... 101/44, 43, 41, 101/38.1, 40, 40.1, 9, 10, 11, 316

[56] References Cited

U.S. PATENT DOCUMENTS

| | | | |
|---|---|---|---|
| 2,751,701 | 6/1956 | Grupe | 101/11 |
| 2,935,015 | 5/1960 | Wilson et al. | 101/44 |
| 3,688,695 | 9/1972 | James | 101/44 |
| 3,732,807 | 5/1973 | Roberston | 101/11 |
| 4,574,694 | 3/1986 | Dubuit | 101/11 |
| 5,307,740 | 5/1994 | Yamamoto et al. | 101/44 |

FOREIGN PATENT DOCUMENTS

| | | |
|---|---|---|
| 1348836 | 12/1963 | France . |
| 2552713 | 4/1985 | France . |
| 646410 | 5/1937 | Germany . |

OTHER PUBLICATIONS

The Journal of Applied Pneumatics, vol. 4, No. 32, 1962, p. 7 XP 000001608 'Hot Foil Marking Machine' *p. 7, left column, line 7–12; figure 1*.

*Primary Examiner*—Christopher A. Bennett
*Attorney, Agent, or Firm*—Young & Thompson

[57] ABSTRACT

A printing machine comprises a printing station at which two shells are adapted to enclose the object to be printed, the shells being subject to a drive mechanism which acts directly on one of them, whereas it acts on the other through the intermediary of at least two movement reverser columns. The machine further comprises a conveyor equipped with at least one object-carrier support and which is mobile in order to move the support between the shells of the printing station. The conveyor is a turntable rotating about one of the movement reverser columns. Applications include the printing of synthetic material bottles.

12 Claims, 4 Drawing Sheets

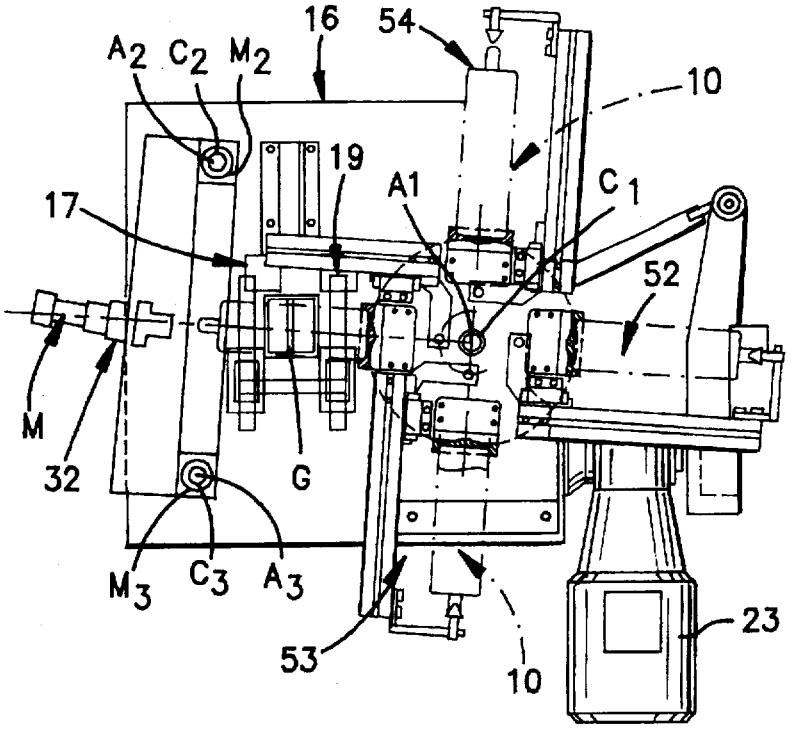
FIG. 6
FIG. 7
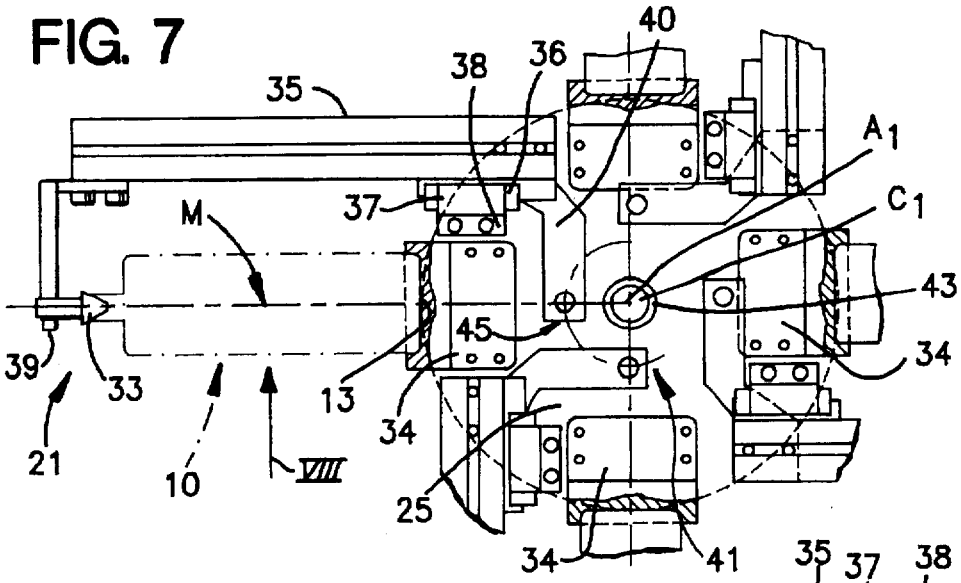
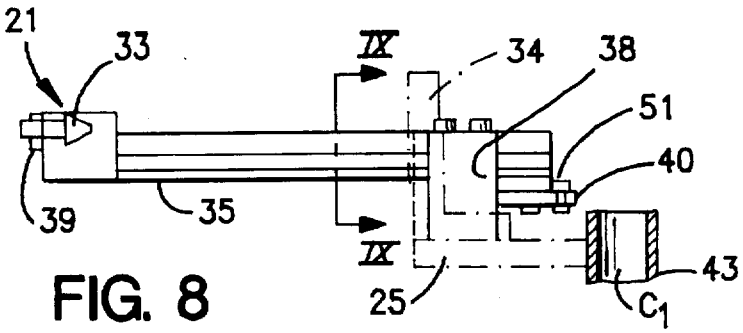
FIG. 8
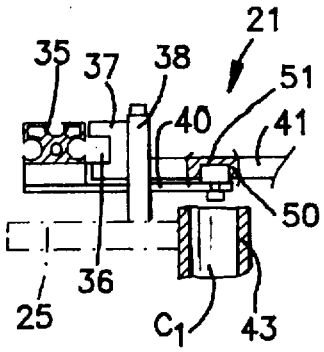
FIG. 9

PRINTING MACHINE WITH GOLD BLOCKING PRESS TYPE PRINTING STATION

BACKGROUND OF THE INVENTION

1. Field of the Invention

The present invention concerns printing machines of the kind including a printing station of the gold blocking press type in which, to print an object, two shells are adapted conjointly to enclose at least one part of the object, the shells being subject to a control mechanism which acts directly on one of them and acts on the other through the intermediary of at least two parallel movement reverser columns mounted on the frame of the system to slide along their axis.

2. Description of the Prior Art

A printing machine of this kind is described in U.S. Pat. No. 4,574,694, for example.

It is desirable to juxtapose with a printing machine of this kind a conveyor serving it and equipped with at least one object-carrier support, the conveyor being mobile relative to its frame so as to move the object-carrier support between the shells of the printing station.

In U.S. Pat. No. 4,574,694 mentioned above, which concerns a printing machine including a plurality of aligned printing stations, the conveyor is naturally a linear conveyor with its length parallel to the line of printing stations.

Because of its length, this linear conveyor inevitably has a relatively large footprint.

Although this footprint is justified for a printing machine including a plurality of aligned printing stations, it is unacceptable for a printing machine including only one station.

Rotary conveyors in which the conveyor is implemented in the form of a turntable, a turntable-turret or a drum are known in themselves.

However, in the present application the conveyor is intended to operate between the movement reverser columns of the printing station so that using a rotary conveyor of this kind would normally require the movement reverser columns to be separated by a distance at least equal to the slewing diameter of the rotary conveyor, which would inevitably be to the detriment of the compactness and therefore the overall size of the machine as a whole.

One object of the present invention is an arrangement enabling the overall size of the machine to be very substantially reduced.

SUMMARY OF THE INVENTION

The present invention consists in a printing machine of the kind including, firstly, a gold blocking press type printing station at which two shells are adapted conjointly to enclose at least one part of an object to be printed, said shells being subject to a drive mechanism that acts directly on one of them whereas it acts on the other through the intermediary of at least two parallel movement reverser columns mounted on a frame of the machine to slide along their axis, and, secondly, a conveyor equipped with at least one object-carrier support and mobile relative to said frame so as to move said object-carrier support between said shells of said printing station, wherein said conveyor includes a turntable coaxial with one of said movement reverser columns of said printing station and disposed radially around the latter.

It is then sufficient for the movement reverser columns to be separated by a distance slightly greater than the slewing radius of the conveyor, rather than its slewing diameter.

The overall size of the machine is thereby advantageously halved.

The printing machine of the invention therefore has the advantage of great compactness.

The printing station preferably includes three movement reverser columns disposed along respective edges of a triangular cross-section prism and its drive mechanism is disposed at the barycenter of the basic or base triangle of the prism.

This has the advantage of making the system rugged and efficient.

These features and advantages, along with others, emerge from the following description given by way of example with reference to the accompanying diagrammatic drawings.

BRIEF DESCRIPTION OF THE DRAWINGS

FIG. 6 is a plan view of the printing machine of the invention in section on the line VI—VI in FIG. 2.

FIG. 7 is a locally cut away plan view to a larger scale which, corresponding to that of FIG. 6, relates to one of the individual object-carrier supports equipping the conveyor used in the printing machine of the invention.

FIG. 8 is an elevation view of this object-carrier support as seen in the direction of the arrow VIII in FIG. 7.

FIG. 9 is a view of it in cross-section on the line IX—IX in FIG. 8.

DETAILED DESCRIPTION OF THE PREFERRED EMBODIMENT

Figure 1:
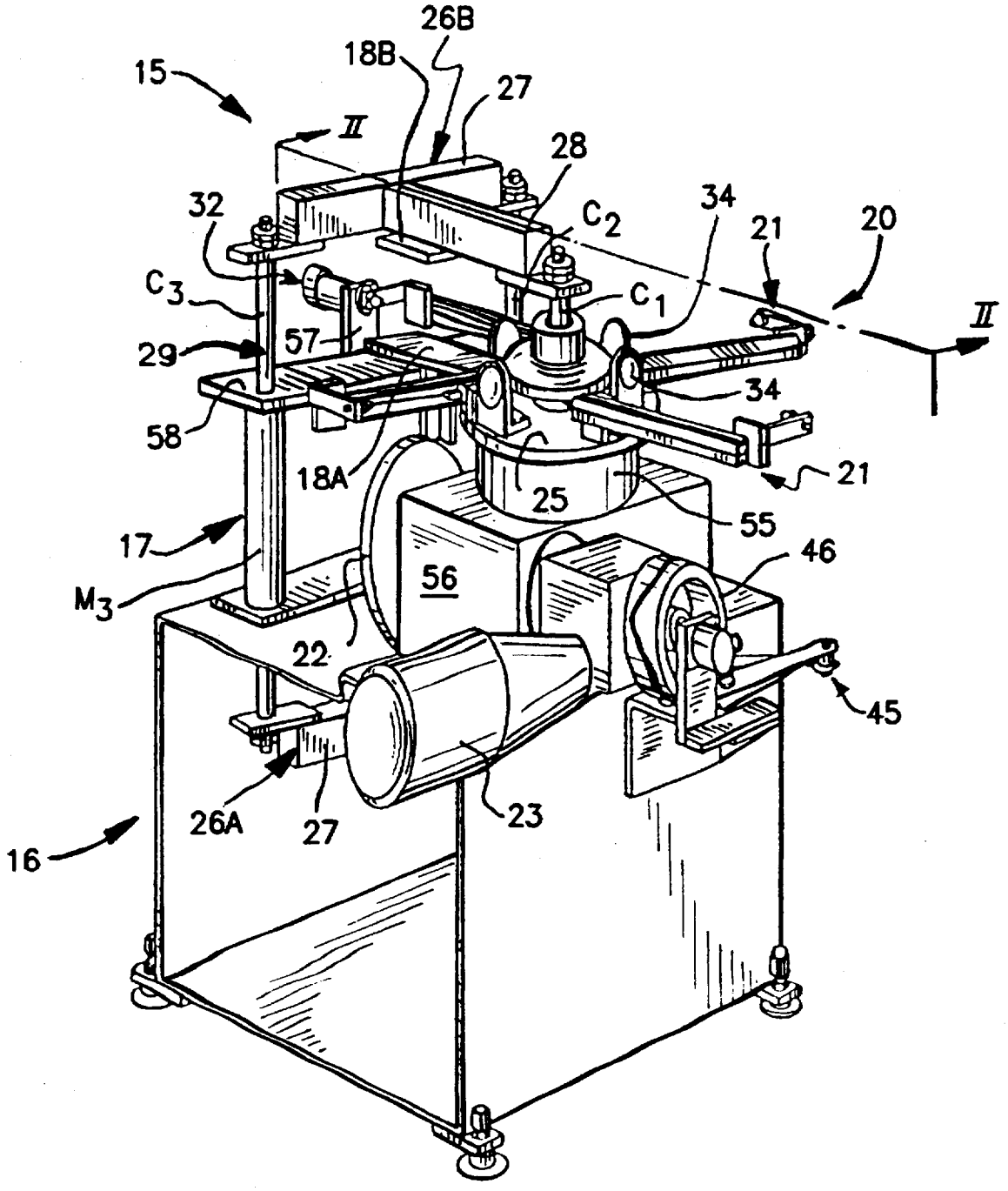
FIG. 1 is a perspective view of a printing machine of the invention.

As shown diagrammatically in chain-dotted line in some of the figures, the objects 10 to be printed are bottles having, in the manner known in itself, a body 11, a neck 12 and a bottom 13.

In practise these are synthetic material bottles.

A printing machine 15 is used to print them.

In addition to a frame 16, the printing machine 15 includes, firstly, in a manner that is known in itself, a gold blocking press type printing station 17 at which two shells 18A, 18B are adapted conjointly to enclose at least a part of an object 10 to be printed, to be more precise at least a part of the body 11 of the latter, the shells 18A, 18B being conjointly subject to a drive mechanism 19, in practise a toggle lever type mechanism, which acts directly on one of them, in this instance the shell 18A, whereas it acts on the other, in this instance the shell 18B, through the intermediary of at least two parallel columns C1, C2, . . . conjointly mounted on the frame 16 of the system to slide along their axis, and, secondly, a conveyor 20 equipped with at least one object-carrier support 21 and mounted mobile relative to the frame 16 so as to move the object-carrier support 21 between the shells 18A, 18B of the printing station 17.

As the frame 16 is not in itself relevant to the present invention it will not be described in detail here.

Likewise the drive mechanism 19, which is well known in itself.

Suffice to say that in this application the drive mechanism 19 is controlled by a cam 22 rotatably mounted on the frame 16 and driven by a gear motor 23 carried by the latter.

To simplify the drawings, in FIG. 1 the shells 18A, 18B are shown by means of the plates to which enclosing members having the shape appropriate to the object 10 to be printed are attached as and when required.

Figure 2:
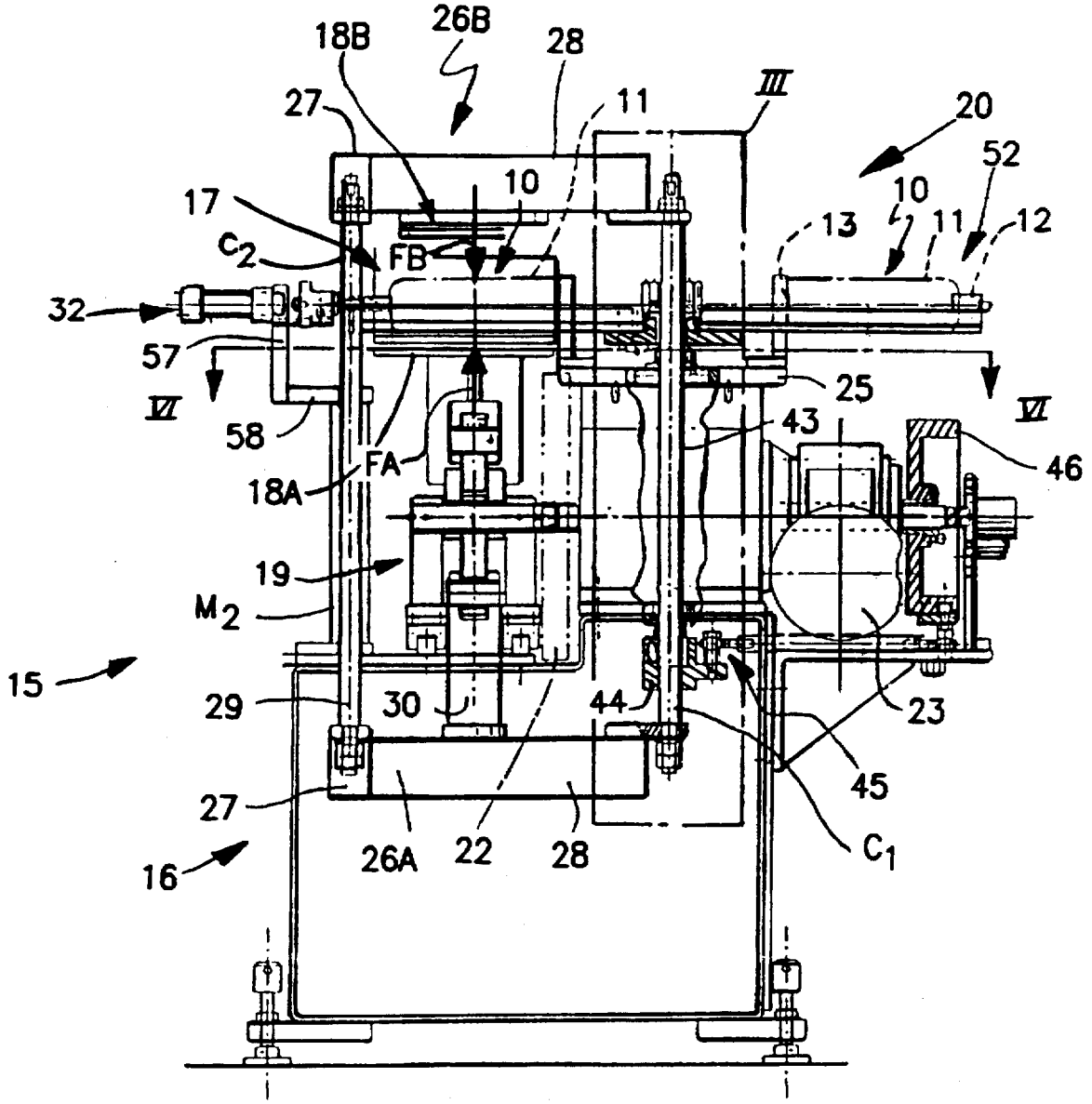
FIG. 2 is a view of the machine in elevation and in section on the line II—II in FIG. 1.
Figure 3:
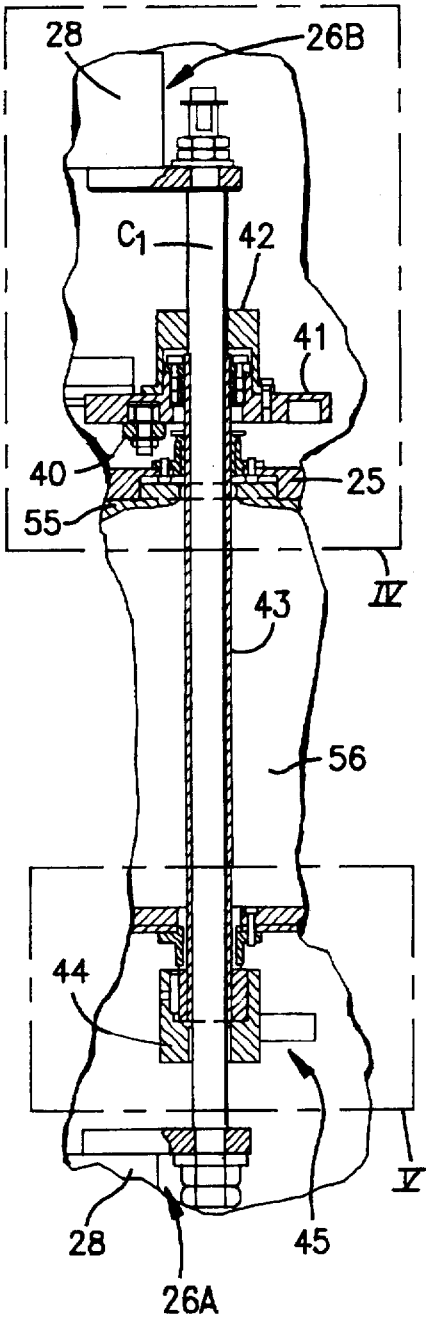
FIG. 3 shows the detail III of FIG. 2 to a larger scale.

These members are nevertheless shown diagrammatically in chain-dotted line in FIG. 2.

In a manner that is known in itself the conveyor 20 comprises a circular contour turntable 25.

In accordance with the invention, the turntable 25 is coaxial with one of the movement reverser columns C1, C2, . . . of the printing station 17, in this instance the movement reverser column C1, extending radially around the latter.

In the embodiment shown the printing station 17 has three movement reverser columns C1, C2, C3 disposed along an imaginary right prism having on a triangular base.

The locations of the axes A1, A2, A3 along which the movement reverser columns C1, C2, C3 extend are shown in FIG. 6.

They are at the corners of a triangle which is the basic or base triangle of the corresponding prism.

In the embodiment shown this basic triangle is an equilateral triangle.

To synchronize them, the movement reverser columns C1, C2, C3 are joined together by a structure 26A at their bottom end and by a structure 26B at their top end.

In the embodiment shown the structures 26A, 26B are similar if not identical.

Each of them is a T-shaped structure comprising two mutually orthogonal members, namely a member 27 which joins together the movement reverser columns C2, C3 opposite the movement reverser column C1 around which the platform 25 of the conveyor 20 is disposed and a member 28 which joins the movement reverser column C1 to the middle of the previous member 27, along the corresponding mid-perpendicular or bisector M of the basic or base triangle of the prism along the edges of which the movement reverser columns C1, C2, C3 extend.

With the structures 26A, 26B that join them together, the movement reverser columns C1, C2, C3 form a relatively rigid framework 29.

To guide this framework 29 the movement reverser columns C2, C3 opposite the movement reverser column C1 around which the turntable 25 of the conveyor 20 is disposed are each individually slidably engaged in tubular uprights M2, M3 projecting vertically from the top of the frame 16.

The drive mechanism 19 of the printing station 17 is disposed at the barycenter G of the basic triangle of the prism along the edges of which the movement reverser columns C1, C2, C3 extend (FIG. 6).

A leg 30 of the drive mechanism 19 operates on the structure 26A joining together the bottom ends of the movement reverser columns C1, C2, C3 (FIG. 2).

The shell 18B is carried by the structure 26B joining together the top ends of the movement reverser columns C1, C2, C3.

When the drive mechanism 19 is actuated, under the control of the cam 22, it moves the shell 18A axially in one direction towards the object 10 to be printed, as shown by the arrow FA in FIG. 2; at the same time, through the intermediary of the leg 30 and the framework 29 comprising the movement reverser columns C1, C2, C3, it moves the shell 18B in the opposite axial direction, also towards the object 10 to be printed, as shown by the arrow FB in FIG. 2.

The shells 18A, 18B therefore enclose the object 10 to be printed.

When it is at the printing station 17, the object-carrier support 21 carried by the turntable 25 of the conveyor 20 is preferably globally aligned with the mid-perpendicular M of the basic or base triangle of the prism along the edges of which the movement reverser columns C1, C2, C3 extend, and the printing station 17 is provided with blower means 32 aligned with the median line M and adapted to pressurize the internal volume of the object 10 to be printed.

The blower means 32 employ a blower nozzle which, disposed outside the basic or base triangle of the prism along the edges of which the movement reverser columns C1, C2, C3 extend, being carried by a bracket 57 attached to a crossmember 58 fixed to the tubular uprights M2, M3, is mobile along the mid-perpendicular M of the basic or base triangle and is pressed against the object-carrier support 21 in order to communicate with the neck 12 of the object 10 to be printed via the corresponding component of the object-carrier support 21.

As the corresponding arrangements will be obvious to the person skilled in the art, they will not be described in more detail here.

The object-carrier support 21 carried by the turntable 25 of the conveyor 20 includes two members 33, 34 adapted to enclose an object 10 to be printed between them, engaging axially with the neck 12 of the latter in the case of the member 33 and with the bottom 13 of the object 10 in the case of the member 34; to this end, at least one of these members is mobile on the turntable 25.

In the embodiment shown only one of the members 33, 34 of the object-carrier support 21 is mobile on the turntable 25.

In this example, it is the member 33 engaging axially with the neck 12 of an object 10 to be printed.

In a manner that is known in itself, the member 33 is pointed in shape and hollow to enable the intervention of the blower means 32, as previously explained.

The member 33 is mobile parallel to the turntable 25, along a radius of the latter.

In the embodiment shown, the member 33 is carried by an arm 35 which is parallel to the turntable 25 of the conveyor 20 and has a bar 36 slidably engaged with a slideway 37 attached to the turntable 25 by a flange 38 and extending cantilever fashion beyond the edge of the turntable 25.

At one end the arm 35 carries a bracket 39 with the member 33 at its end.

For reasons that emerge below, the member 33 is rotatably mounted on the bracket 39.

At the other end, the arm 35 carries a lug 40 through which movement of the member 33 is controlled by a cam 41.

The cam 41 rotates about the movement reverser column C1 around which the turntable 25 is disposed (FIG. 4) and is constrained by a nut 42 to rotate with a tube 43 coaxially surrounding the movement reverser column C1.

Figure 5:
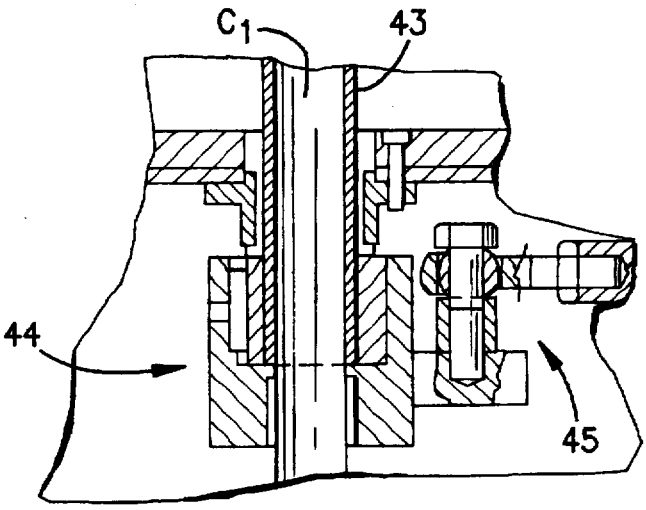

The bottom end of the tube 43 is attached to a nut 44 (FIG. 5); through a linkage 45, the nut is controlled by a cam 46 driven by the gear motor 23 (FIG. 1).

Thus, in the embodiment shown, the drive mechanism 19 operating the shells 18A, 18B of the printing station 17, on the one hand, and the cam 41 operating the mobile member 33 of the object-carrier support 21, on the other hand, are driven by the same member, namely the output shaft of the gear motor 23.

As a result, they operate synchronously.

Figure 4:
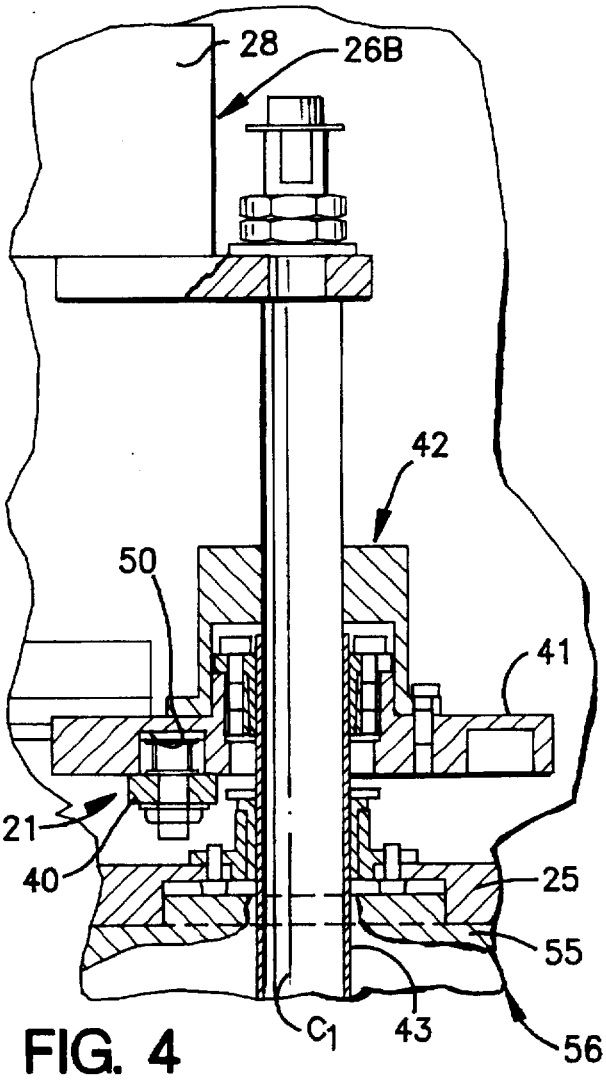
FIGS. 4 and 5 respectively show the details IV and V of FIG. 3 to a still larger scale.

As shown diagramatically in chain-dotted line in FIG. 7, and as can be seen in FIG. 4, the cam 41 includes a recessed track 50 on its bottom surface engaged with a roller 51 rotatably mounted on the lug 40 carried by the arm 35.

The path of the track 50 is designed to impart to the arm 35, and therefore to the member 33 that it carries, the necessary reciprocating movement to enclose and to release an object 10 to be printed.

The member 34 of the object-carrier support 21 forms a bearing block attached by a bracket 51 to the turntable 25, its shape being adapted to receive the bottom 13 of an object 10.

In the embodiment shown, the turntable 25 of the conveyor 20 has four object-carrier supports 21 equiangularly distributed around the movement reverser column C1 it surrounds, in a cruciform arrangement.

In this way a loading station 52 diametrally opposite the printing station 17 is provided in addition to a printing station 17, with a marker station 53 and an offloading station 54 in a cruciform arrangement relative to them.

Between the loading station 52 and the printing station 17, in the direction of rotation of the turntable 25, which is assumed to be clockwise in the embodiment shown, the marker station 53 rotates the object 10 to be printed upon itself until the object 10 occupies a particular angular position about its axis on the object-carrier support 21 carrying it.

The members 33, 34 of the object-carrier support 21 are designed accordingly.

As the corresponding arrangements are well known in themselves, they will not be described in more detail here.

As a result, the subsequent printing effected on the object 10 is at an appropriately determined location on the latter.

The turntable 25 of the conveyor 20 is driven stepwise to halt each object-carrier support 21 that it carries in succession at the various stations 52, 53, 17 and 54 previously described; to this end it is locked to the output member 55 of an indexing device 56 through which the movement reverser column C1 and the tube 43 surrounding the movement reverser column C1 pass in the axial direction and which is driven by the gear motor 23.

Of course, the present invention is not limited to the embodiment described and shown, but encompasses any variant execution thereof.

There is claimed:

1. Printing machine comprising a frame, a gilding press printing station including two shell members adapted together to enclose at least part of an object to be printed, a drive mechanism acting directly on one of the shell members and acting on the other of the shell members through at least two parallel movement reverser columns mounted for sliding movement along their axes, a conveyor carrying at least one object-carrier support, said conveyor being mobile relative to said frame for moving said at least one object-carrier support between said shell members, said conveyor including a turntable coaxial with one of said columns and extending radially outwardly thereof.

2. Printing machine according to claim 1, wherein there are three said movement reverser columns which are disposed at the printing station and extend along edges of an imaginary prism having a triangular base.

3. Printing machine according to claim 2, wherein the drive mechanism of said printing station is located at the barycenter of the triangular base.

4. Printing machine according to claim 2, wherein when said at least one object-carrier support is located at the printing station, said at least one object-carrier support extends along a bisector of an angle of the triangular base.

5. Printing machine according to claim 4 adapted for printing objects such as bottles of synthetic material, and further comprising blower means disposed at said printing station to pressurize the internal volume of an object to be printed.

6. Printing machine according to claim 2 wherein the triangular base is an equilateral triangle, said columns being equidistant from one another.

7. Printing machine according to claim 1 further comprising an indexing device having an output member, said turntable of said conveyor being fixed for movement with the output member of the indexing device, the said one movement reverser column extending axially through said output member.

8. Printing machine according to claim 1 wherein said object-carrier support includes two members adapted to grip therebetween an object to be printed, at least one of said two members being mounted for movement on the turntable, a cam for controlling said at least one member being rotatably mounted about said one column, a tube extending coaxially around said one column, said cam being constrained to rotate with said tube.

9. Printing machine according to claim 1 wherein said object-carrier support includes two members adapted to grip therebetween an object to be printed, at least one of said two members being mounted for movement on the turntable, a cam for controlling said at least one member being rotatably mounted about said one column, a tube extending coaxially around said one column, said cam being constrained to rotate with said tube, a nut attached to said tube, a cam acting through a linkage for controlling the nut.

10. Printing machine according to claim 7 further comprising an arm carrying said one member of said object-carrier support, said arm extending parallel to said turntable and slidably engaged in a slideway attached to said turntable and projecting cantilever fashion therebeyond.

11. Printing machine according to claim 7 further comprising a common member controlling said driven mechanism and said cam.

12. Printing machine according to claim 1 wherein said turntable of said conveyor includes four object-carrier supports equi-angularly spaced around said one column.

* * * * *